US007416187B2

(12) United States Patent
Forster

(10) Patent No.: US 7,416,187 B2
(45) Date of Patent: Aug. 26, 2008

(54) BLACKJACK AND POKER GAME COMBINATION

(76) Inventor: Michael Forster, 1810 Leola St., Lomita, CA (US) 90717

( * ) Notice: Subject to any disclaimer, the term of this patent is extended or adjusted under 35 U.S.C. 154(b) by 411 days.

(21) Appl. No.: 11/235,813

(22) Filed: Sep. 26, 2005

(65) Prior Publication Data

US 2007/0069467 A1 Mar. 29, 2007

(51) Int. Cl.
*A63F 1/00* (2006.01)

(52) U.S. Cl. ..... 273/292; 273/274

(58) Field of Classification Search ..... 273/292, 273/274, 309; 463/12, 13
See application file for complete search history.

(56) References Cited

U.S. PATENT DOCUMENTS

| | | | | |
|---|---|---|---|---|
| 5,678,821 | A | 10/1997 | Hedman | |
| 5,713,574 | A | 2/1998 | Hughes | |
| 5,988,643 | A * | 11/1999 | Awada | 273/292 |
| 6,012,719 | A | 1/2000 | Webb | |
| 6,523,831 | B2 | 2/2003 | Webb | |
| 6,749,200 | B2 * | 6/2004 | Yurkins | 273/292 |
| 6,773,013 | B2 | 8/2004 | Caldwell | |
| 6,854,733 | B2 | 2/2005 | Webb | |
| 6,877,748 | B1 | 4/2005 | Patroni et al. | |
| 2004/0000758 | A1 | 1/2004 | Yurkins | |
| 2004/0160006 | A1 | 8/2004 | Kenny et al. | |
| 2004/0239033 | A1 | 12/2004 | Zahedi | |

* cited by examiner

*Primary Examiner*—Benjamin H Layno
(74) *Attorney, Agent, or Firm*—Roland Tong

(57) ABSTRACT

A gaming method is disclosed and comprises the following steps, which need not necessarily be performed in the exact order: providing at least two card representations to a player, each card representation comprising a symbol, the symbol having a corresponding predetermined value; providing at least two card representations to a dealer, each card representation comprising a symbol, the symbol having a corresponding predetermined value; evaluating a blackjack game outcome by comparing the values of the player and the dealer's card representations, wherein the player wins the blackjack game if the sum of the predetermined values of the player's card representations is higher than the dealer's; using two of the player's card representations for a game of poker; using two of the dealer's card representations for a game of poker; defining values for a plurality of combinations of two card representations; and evaluating a poker game outcome based on the player and the dealer's two card representations, wherein the player wins the poker game when the player possesses a two card combination that has a higher predetermined value than any of the dealer's two card combination.

37 Claims, 2 Drawing Sheets

BLACKJACK AND POKER GAME COMBINATION

CROSS REFERENCES TO RELATED APPLICATIONS

None

FIELD OF INVENTION

The present invention relates to methods of playing games of chance, particularly games of Blackjack and Poker.

BACKGROUND

Conventional betting games, such as slot machines, video poker games, and various table games, such as roulette, blackjack, poker, and craps, are the main attractions of casinos and gambling places like Las Vegas, as they have been for many years. Many casino patrons enjoy playing these conventional betting games for many reasons, including the patrons may have developed what they believe to be winning techniques or strategies; they may have become accustomed to the frequency and size of the awards; or, they may have become very well accustomed with the rules. Some of these casino patrons desire some change in these games to add flavor and excitement to these old games and to add new challenges to their gaming experiences. The applicant has discovered ways to modify existing blackjack and poker games in a manner that the applicant believes preserves the attractiveness and familiarity of players with conventional blackjack and poker games while at the same time providing the flavor, excitement, and challenge that casino patrons seek.

Several patents and patent applications disclose modifications to the conventional games of blackjack and poker. For instance, U.S. Patent Application Publication number US 2004/0000758 of Yurkins appear to disclose a game that combines blackjack and poker. The Yurkins patent application involves the players being invited to play either blackjack, poker, or both games, and the players who have opted to play poker are given a total of five cards.

At least one problem with the game disclosed in Yurkins is that it requires the dealer to use substantially more cards than the conventional blackjack game. In the game of blackjack, players often seek high cards, such as kings, jacks, queens, tens, and aces, for their two initial cards to maximize their chances of having two initial cards with the highest possible predetermined value, or to minimize the chances of having to "hit" or obtain an additional card and "busting" or exceeding twenty one. Some players may feel that high cards are being used up quickly in the game of Yurkins, which makes the game of blackjack more favorable to the house. A modified blackjack and poker game that uses fewer cards than the card consumption in Yurkins is desired.

Another problem with the game of Yurkins is that it utilizes five cards to play poker. Blackjack players who are not familiar with conventional five card poker combinations, such as straight, flush, royal flush, and full house, may feel disinterested in learning a game that is substantially different from blackjack. A blackjack/poker game combination that does not require players to be able to form or evaluate conventional five card poker combinations, such as straights, flushes, full house, or variations thereof, is desired.

Yet another problem with the game disclosed by Yurkins is that dealers have to evaluate substantially more winning combinations than the winning combinations involved in conventional blackjack. Thus, Yurkins's game appears to require that the dealers be trained in evaluating both blackjack and five card poker combinations. This poses additional operating cost or overhead expenses to casino operators. Yurkins's game may also require casino operators or dealers to take extra time during each game to evaluate the outcomes of blackjack plus the five card poker. A modified blackjack and poker game that allows dealers to move quickly from one game to another is desired.

Another blackjack/poker combination is disclosed in U.S. Pat. Nos. 6,854,733, 6,012,719, and 6,523,831, which are all issued to Webb. Webb discloses a three card poker and blackjack combination wherein the poker hand consists of two cards that the player obtains from playing blackjack and the card of the dealer that is shown to the player. Webb provides certain definitions of winning three card hands and losing three card hands. Like the problem with the game of Yurkins, the dealers executing the games of Webb may have to be trained with the definitions of winning three card hands and losing three card hands. The dealers may have to take extra time during each game to evaluate the outcomes of blackjack and the three card poker.

From the players' perspective, players may have to get acquainted with these definitions as well. Some players may find the definitions of winning three card hands and losing three card hands overwhelming, and they may be hesitant to learn them. A blackjack/poker game combination that allows both players and dealers to quickly learn and understand the game is desired. Finally, a blackjack/poker game combination that does not substantially have the disadvantages of the references cited above is desired.

BRIEF DESCRIPTION OF THE PREFERRED EMBODIMENTS OF THE PRESENT INVENTION

A gaming method is disclosed and comprises the following steps, which need not necessarily be performed in the exact order: providing at least two card representations to a player, each card representation comprising a symbol, the symbol having a corresponding predetermined value; providing at least two card representations to a dealer, each card representation comprising a symbol, the symbol having a corresponding predetermined value; evaluating a blackjack game outcome by comparing the values of the player and the dealer's card representations, wherein the player wins the blackjack game if the sum of the predetermined values of the player's card representations is higher than the dealer's; using two of the player's card representations for a game of poker; using two of the dealer's card representations for a game of poker; defining values for a plurality of combinations of two card representations; and evaluating a poker game outcome based on the player and the dealer's two card representations, wherein the player wins the poker game when the player possesses a two card combination that has a higher predetermined value than any of the dealer's two card combination.

The above description sets forth, rather broadly, a summary of embodiments of the present invention so that the detailed description that follows may be better understood and contributions of the present invention to the art may be better appreciated. Some of the embodiments of the present invention may not include all of the features or characteristics listed in the above summary. There may be, of course, other features of the invention that will be described below and may form the subject matter of claims. In this respect, before explaining at least one embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF THE PREFERRED EMBODIMENTS

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. Also, it is to be understood that the phraseology and terminology employed herein are for the purpose of description and should not be regarded as limiting.

The order in which the steps are presented below is not limited to any particular order and does not necessarily imply that they have to be performed in the order presented. It will be understood by those of ordinary skill in the art that the order of these steps can be rearranged and performed in any suitable manner. It will further be understood by those of ordinary skill in the art that some steps may be omitted or added and still fall within the spirit of the invention.

Figure 1:
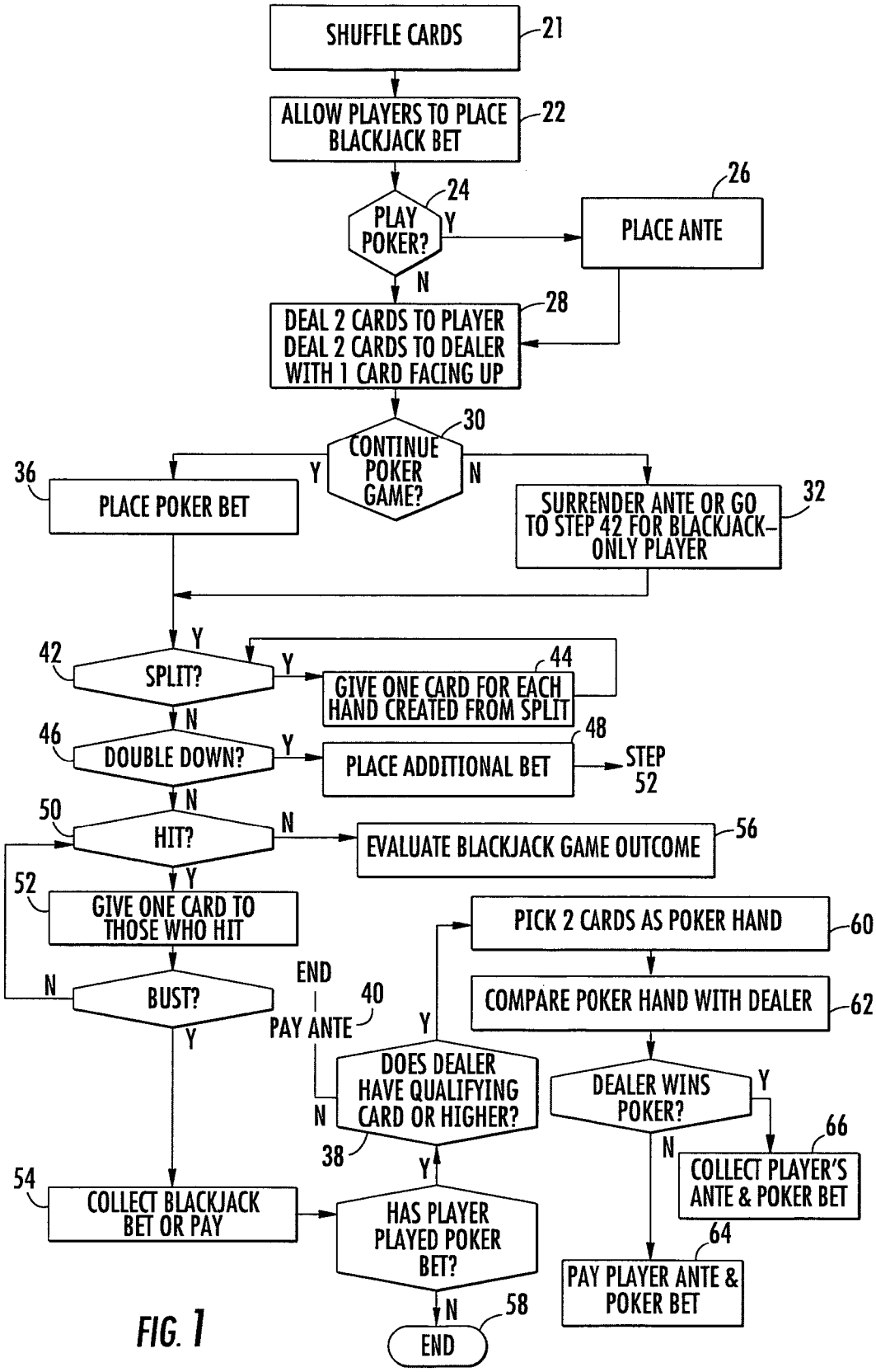
FIG. 1 is substantially a flowchart of one embodiment of the blackjack/poker game combination of the present invention.

The present invention comprises various embodiments of a method of playing a blackjack and poker game combination. Referring to FIG. 1, one embodiment is shown wherein at step 21 a dealer preferably shuffles a plurality of cards. The players may then place their bets for a game of blackjack (step 22). At step 24, the players are preferably invited to play a game of poker. If at least one player wants to play poker, at step 26, the player is preferably required to place an ante.

Regardless of whether any player wants to play poker, the dealer preferably deals two cards to each player and two cards to the dealer. In the preferred embodiment, one of the dealer's cards preferably shows a gaming symbol, such as numbers, suit, or rank, to the players and the dealer (step 28) (hereinafter "face" card). It can be realized that the face card gives some indication to the players of how they will perform against the dealer in both blackjack and poker games. Thus, based on the face card, the players may decide whether to continue playing the poker game at step 30.

For the players that placed an ante for poker, these players preferably have to decide whether to continue playing poker (step 30). If the player decides not to continue playing poker, the ante from step 26 is preferably surrendered to the dealer (step 32). If the player decides to continue playing poker, at step 36, the player is preferably required to place a poker bet, which is preferably twice that of the ante from step 26. Of course, the proportion between the ante and the poker bet may be modified and still fall within the scope of the invention.

After the player places the poker bet or if the player decided not to play poker, the blackjack game is preferably played. In blackjack, each player preferably competes against the dealer to have a set of cards that has a combined value that is closest to twenty one. The set of cards that is closest to twenty one between one player and the dealer is preferably awarded even money. The combination of either a king, queen, jack, or ten and an ace is preferably awarded 3 to 2. Kings, queens, and jacks preferably have a numerical value of ten. Aces may count either as one or eleven.

The blackjack game is preferably played starting at step 42 wherein the player is asked whether the player wants to split his cards. If the player wants to split his cards, the dealer preferably hands the player one card for each hand created from the split (step 44). In the preferred embodiment, the player may only be allowed to split his cards once. Of course, this rule may be modified and each player may be allowed to split his hands as many times as the player wishes. Next, at step 46, the player may decide whether to double down. If the player decides to double down, the player preferably places his double down bet. One card may then be provided to the player (step 52).

The dealer and the players may be prompted to "hit" or obtain more cards to get closer to twenty one (step 50). In the preferred embodiment, the player who has doubled down is preferably prevented from obtaining more than one card after the double down bet was placed. If a player or a dealer hits, one card is preferably provided to that person (step 52). The dealer preferably may not be allowed to "hit" or has to "stand" when he has a two-card value amounting 17 and the two card value includes a ten, a queen, a jack, or a king. The dealer preferably has to "hit" or obtain at least one more card when the dealer's two-card value is 17 and the dealer's set of cards includes an ace (commonly referred to as a "soft 17"). It is noted that this rule may be preferred when the house wants to take the opportunity to improve the dealer's poker hand by virtue of the extra card that the dealer will obtain from the required "hit."

The player may hit as many times as he wants to get closer to twenty one. However, the player preferably cannot hit anymore once the dealer hits or once the player's turn to hit has passed. If the player stands or busts, the dealer is preferably asked whether to hit or stand (step 50). It is noted that the above rules regarding the ability of the player or the dealer to "hit" are mainly for describing one embodiment of how the invention may be practiced. Other embodiments of playing the blackjack and poker game combination of the present invention may be executed, which may include slight modifications of the above rules. For instance, when the house wants to increase the player's chance for winning the poker game, the above rule may be modified such that the dealers may be required to stand on all 17s even if the dealer's 17 is a soft 17. By virtue of this modification, the dealer waives the opportunity to obtain an additional card that may improve his poker hand. These other embodiments still fall within the spirit and scope of the invention.

Once the dealer is finished hitting by deciding to stand or by busting, the blackjack outcome is preferably determined by comparing the values of the player and the dealer's hand (step 56). The hand that has a value that is closest to twenty one wins. The dealer and the players may "bust" if they exceed twenty one. If a player's blackjack hand busts, the hand loses and the blackjack bet may be collected. Otherwise, the player may be awarded depending on how close the sum of his cards is to twenty one compared to the dealer's cards (step 54).

Next, if no player has placed an ante and a poker bet, the game preferably ends (step 58). It is noted that even if the player or the dealer's blackjack hand busts, the player may continue to play poker if he has placed an ante and a poker bet.

If the dealer's blackjack hand busts, but the dealer has a card that is at least as high as the qualifying card, the dealer may also continue to play poker. As used herein, the term "qualifying card" means a card of a particular number, suit, or rank that sets the minimum card value for the dealer to possess in order to participate in the poker game. In the preferred embodiment, the qualifying card is a queen regardless of suit. Thus, the dealer must have a queen or higher to continue playing poker. In other embodiments, the qualifying card may be the card that is determined from statistical studies to provide the optimal advantage to the house. If at least one player has placed an ante and a poker bet, at step 38, the dealer preferably determines whether he has a card that has at least the value of a qualifying card (step 38).

If the dealer does not have at least the value of the qualifying card, the dealer preferably pays the player an amount equivalent to the player's ante (step 40). All the players who have indicated an intention to play poker wins an amount preferably equivalent to the ante, and the poker game preferably terminates. If the dealer has a qualifying card or better, the game of poker is preferably played by selecting preferably the two best cards of each player and the dealer (step 60). The two best cards are preferably the combination that has the highest numerical value, highest rank, or highest pair.

Each player's poker hand is preferably compared against the dealer's poker hand (step 62). The player preferably wins against the dealer if one of the following conditions is met: (1) the numerical value or rank of the player's highest card is higher than the dealer's highest card, (2) the player and the dealer's highest cards are the same in value or rank, but the player's second best card has a higher value or rank than the dealer's second best card, (3) the player has two cards of the same number or rank (hereinafter a "pair") and the dealer has no pair, or (4) the player and the dealer has pairs, but the player's pair has a higher value than the dealer's pair. If the player wins, the dealer preferably pays the player an amount equivalent to the sum of the ante and the player's poker bet (step 64). If the dealer wins, the dealer preferably collects the player's ante and poker bet (step 66).

Some rules may be established for the blackjack/poker game combination methods. In the preferred method, the rules include: (1) the player preferably must place a blackjack bet and an ante bet to play poker, (2) dealer's first card is preferably positioned so that the symbol is facing up, (3) the poker bet must be twice the ante bet, (4) both players and the dealer may continue to play poker even if the blackjack hand busted, (5) the two cards used for playing the poker are the best two cards in terms of numerical value or rank, (6) dealer must have a queen or higher to qualify for playing poker, (7) players may only play one hand at a time, except when the player splits during blackjack, (8) dealer must hit on soft 17s, (9) six decks of cards must be used, and (10) the players are preferably given the option to bet on their poker hands before the dealer checks any hands for a blackjack. These rules may be varied as desired by those implementing the method. For instance, the dealer may be required to stand on all 17s including soft 17s. Traditional blackjack procedures, such as allowing players to buy insurance, preferably apply to the blackjack game of the present invention.

Figure 2:
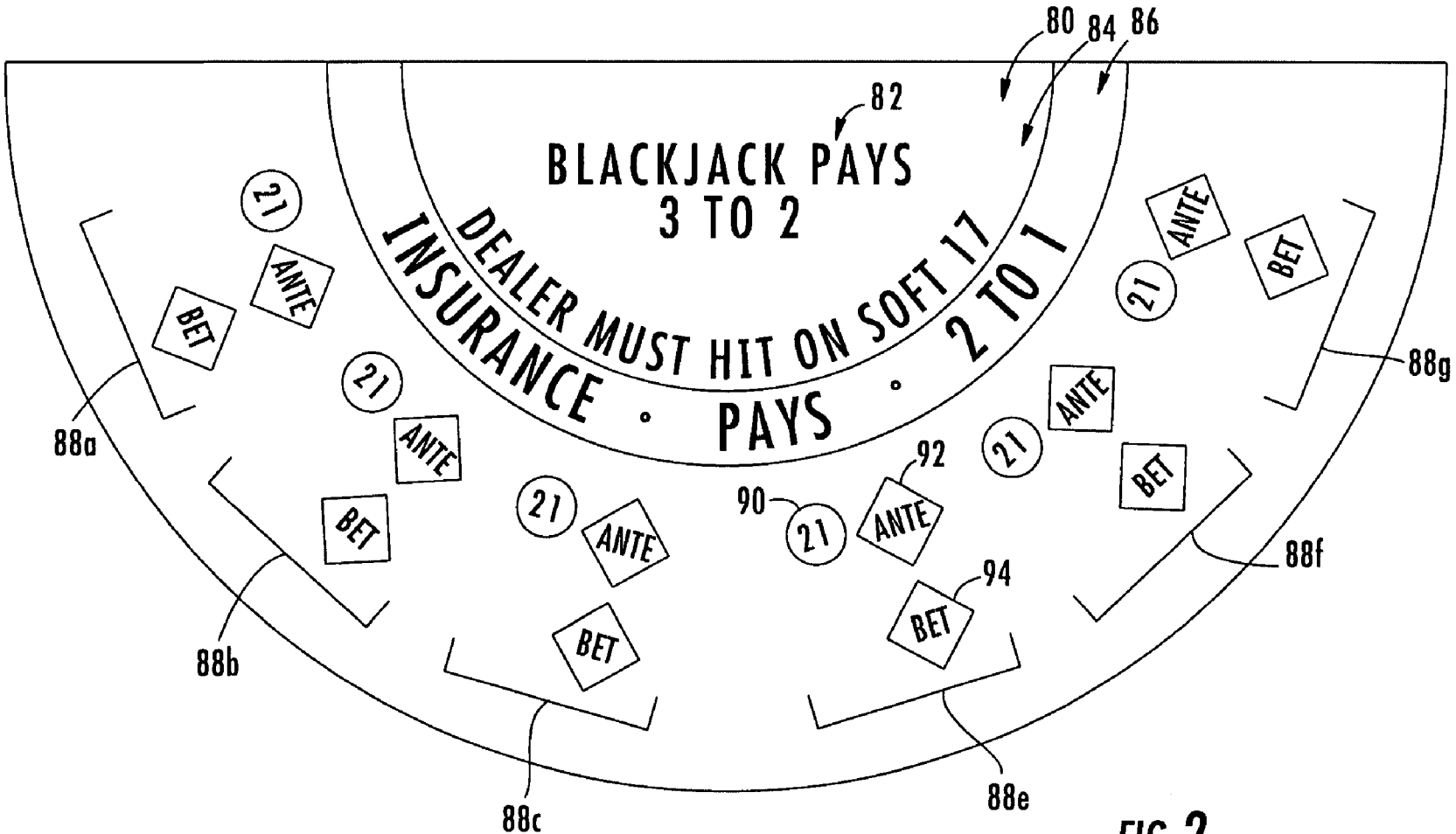
FIG. 2 is substantially a top plan view of a betting layout that may be used to implement a combination blackjack/poker game embodiment.

With reference now to FIG. 2, betting layout 80 may be used to implement the embodiments of the present invention. Betting layout 80 preferably includes a plurality of phrases 82, 84, and 86 that recite some of the rules and some of the awards of the game. For instance, betting layout 80 preferably includes phrase 84, which states "dealer must hit on soft 17." Phrase 82 preferably states "blackjack pays 3 to 2," and phrase 86 preferably states "insurance pays 2 to 1." Of course, the language, positions, and numbers of phrases 82, 84, and 86 may be varied. For instance, if the desired rule is that the dealers must stand on all 17s, phrase 84 may be modified to state "dealer must stand on all 17s."

Betting layout 80 preferably includes a plurality of sets of player betting spots 88*a-g*. The number of sets of player betting spots may be varied. Ideally, seven sets of player betting spots are provided to accommodate up to seven players. Each set of player betting spot preferably includes a blackjack bet position 90, a poker ante position 92, and a poker bet position 94. Blackjack bet position 90 is preferably the position where players place their blackjack bets from step 22. Poker ante position 90 is preferably the position where players place their antes from step 26. Poker bet position 94 is preferably the position where players place their poker bets from step 36. The designs or shapes of bet positions 90, 92, and 94 may be varied. The betting layout 80 may be published on a gaming table, a video screen, or other means of conveying a message to a player.

It can now be realized that the blackjack game of the present invention closely follows the conventional blackjack. Therefore, it can be appreciated that players used to playing traditional blackjack will most likely be attracted to the methods of the present invention, as most of the steps involved in playing traditional blackjack are preserved. These players may also realize that the invention presents them with an opportunity to play a second game along with blackjack. The second game may provide them with a means of breaking the monotony inherent in traditional blackjack games. The second game may also provide them with more opportunities to win money. The present invention opens up various winning strategies for players to win either blackjack, poker, or both and encourages the players to use their creativity and imagination.

They are further provided with new challenges that may be easy to understand and meet. These new challenges may not make conventional blackjack fans feel uncomfortable because of unfamiliarity of the rules or unfamiliarity of the ways to win. The traditional blackjack players may realize that the poker component of the present invention may not use any cards that are substantially more than what is needed to play the blackjack component. Players and dealers alike will find that the present invention is easy to understand and play.

From the casino operators' perspective, it can further be appreciated that certain embodiments of the present invention provides more opportunities to encourage wagers from players while at the same time maintains a desirable speed of play. The poker game component of the present invention does not utilize winning combinations associated with the use of traditional five card poker, such as flushes, straights, and full house. The present invention does not utilize complex modifications to traditional five card poker combinations, such as those presented in the Webb patents. Thus, the game outcomes of the present invention are easy and quick to evaluate. Finally, many casino operators may find the difference between number of games that can be played with the present invention per unit of time versus the number of games per unit of time with conventional poker or conventional blackjack alone minimal and acceptable.

Although the description above contains many specifications, these should not be construed as limiting the scope of the invention but as merely providing illustrations of some of the presently preferred embodiments of this invention. For example, the rules pertaining to the number of decks of cards to be used, the required amount of ante and poker bet, and the dealer standing on all 17s may be varied depending on the gaming preference of a casino operator.

The methods of the present invention need not be implemented using traditional cards made out of paper stock. The methods may be implemented on slot machine bonus games, video games, handheld electronic or electromechanical devices, and computers that may generate images of traditional cards. As used herein, the term "card representations" may be used to refer to real images or artificially generated images of a card having at least a gaming symbol utilized for playing a game of chance.

Some steps may be added or omitted. For instance, bonus features and progressive games may be added to the blackjack/poker combination of the present invention. A bonus feature of rewarding the player if the player possesses a pair of the same suit or rank may be included. The reward may be in a form where the player's poker bet is multiplied, or the reward may be in a form of a progressive prize. The number of players that can be accommodated in a single game may be varied. The invention is capable of other embodiments and of being practiced and carried out in various ways. The invention is not limited in its application to the details of the construction and to the arrangement of the components set forth in the above description or as illustrated in the drawings.

What is claimed is:

1. A gaming method comprising the steps of:

a. allowing a player to play a game of blackjack against a dealer by dealing at least two card to the player, and dealing at least two card representations to the dealer;

b. playing a game of blackjack between the player and the dealer;

c. after playing the blackjack game, allowing the player to play a game of two card poker against the dealer using card representations from the blackjack game, if the player obtained more than two card representations from playing the blackjack game, making the player select no more than two card representations to use for the poker game, if the dealer obtained more than two card representations from playing the blackjack game, making the dealer select no more than two card representations to use for the poker game;

d. defining a dealer qualifying card;

e. comparing the player's two selected card representations against the dealer's two card representations to obtain a poker game outcome if the dealer possesses at least one card representation that meets the definition of the qualifying card.

2. The gaming method of claim 1, wherein the dealer qualifying card is defined to be a queen or better.

3. The gaming method of claim 1, further comprising:

a. requiring an ante from the player to play poker;

b. paying the player an amount equivalent to the ante if the dealer does not have a card representation that meets the definition of a qualifying card.

4. The gaming method of claim 3, further comprising:

a. providing the dealer with at least two card representations, at least one of the two card representations comprising a game indicia;

b. showing the game indicia of at least one of the two card representations to the player; and c. requiring a poker bet from the player to continue playing poker, wherein if the player wins the poker game, the player is paid an amount equal to sum of the ante and the poker bet.

5. The gaming method of claim 4, wherein the poker bet is required to be twice the ante.

6. The gaming method of claim 3, further comprising providing a betting layout, the betting layout comprising a blackjack betting position, an ante betting position, and a poker bet position.

7. The gaming method of claim 1, wherein the player may play poker even if the player's blackjack hand exceeds twenty one.

8. The gaming method of claim 1, wherein the blackjack bet and the ante are not required to be of equal amount.

9. The gaming method of claim 1, further comprising:

a. requiring an ante from the player to play poker;

b. allowing the dealer to obtain a card representation in addition to the two card representations, wherein when the total amount of the dealer's card representations exceeds twenty one, the dealer may still play poker against the player.

10. The gaming method of claim 1, further comprising:

a. requiring an ante from the player to play poker;

b. allowing the player to obtain a card representation in addition to the two card representations; and c. allowing the player to continue playing poker even if the sum of the predetermined numerical values of the player's card representations exceeds twenty one.

11. The gaming method of claim 1, wherein blackjack is played first then poker.

12. The gaming method of claim 1, further comprising:

a. requiring an ante from the player to play poker;

b. allowing the player to obtain a card representation in addition to the two card representations, wherein the added card representation may be used during the game of poker.

13. A gaming method comprising the steps of:

a. providing at least two card representations to a player, each card representation comprising a symbol, the symbol having a corresponding predetermined value;

b. providing at least two card representations to a dealer, each card representation comprising a symbol, the symbol having a corresponding predetermined value;

c. evaluating a blackjack game outcome by comparing the values of the player and the dealer's card representations, wherein the player wins the blackjack game if the sum of the predetermined numerical values of the player's card representations is higher than the dealer's;

d. after playing the blackjack game, if the player obtains more than two card representations during the blackjack game, selecting no more than two of the player's card representations for a game of poker if the dealer obtains more than two card representations during the blackjack game, selecting no more than two of the dealer's card representations obtained from the blackjack game for the game of poker;

e. using only the two selected card representations of the player and the dealer for a game of poker;

f. defining values for a plurality of combinations of two card representations; and g. evaluating a poker game outcome based on the player and the dealer's two card representations, wherein the player wins the poker game when the player possesses a two card combination that has a higher predetermined value than the dealer's two card combination.

14. The gaming method of claim 13, wherein the player wins the poker game when the player has a pair of card representations having the same symbols and the dealer does not have any pair of card representations having the same symbols.

15. The gaming method of claim 13, wherein the player wins the poker game when the player and the dealer each has a pair of card representations having the same symbols and the player that has a pair that has a higher value than the dealer's pair.

16. The gaming method of claim 13, wherein when the dealer obtains a third card representation that causes the sum of the numerical values of the dealer's card representations to exceed twenty one, the dealer may still play poker against the player.

17. The gaming method of claim 13, further comprising defining a dealer qualifying card, the dealer qualifying card being used to determine whether the dealer's card representations can be compared against the player's to obtain a poker outcome.

18. The gaming method of claim 17, wherein the dealer qualifying card is defined to be a queen or better.

19. The gaming method of claim 13, further comprising:

a. requiring an ante from the player to play poker;

b. paying the player an amount equivalent to the ante if the dealer does not have a card representation that meets the definition of a qualifying card.

20. The gaming method of claim 13, wherein the player may play poker even if the player's blackjack hand exceeds twenty one.

21. The gaming method of claim 13, further comprising:

a. showing the symbol of at least one of the two card representations of the dealer to the player; and b. requiring a poker bet from the player to continue playing poker, wherein if the player wins the poker game, the player is paid an amount equal to sum of the ante and the poker bet.

22. The gaming method of claim 21, wherein the poker bet is required to be twice the ante.

23. The gaming method of claim 13, further comprising providing a betting layout, the betting layout comprising a blackjack betting position, an ante betting position, and a poker bet position.

24. The gaming method of claim 13, wherein the blackjack bet and the ante are not required to be of equal amount.

25. The gaming method of claim 13, further comprising:

a. requiring an ante from the player to play poker;

b. allowing the dealer to obtain a card representation in addition to the two card representations, wherein if the sum of the predetermined numerical values of the dealer's card representations exceeds twenty one, the dealer's card representations may still be compared against the player's to obtain a poker game outcome.

26. The gaming method of claim 13, further comprising:

a. requiring an ante from the player to play poker;

b. allowing the player to obtain a card representation in addition to the two card representations; and c. allowing the player to continue playing poker even if the sum of the predetermined numerical values of the player's card representations exceeds twenty one.

27. The gaming method of claim 13, wherein blackjack is played first then poker.

28. The gaming method of claim 13, further comprising:

a. requiring an ante from the player to play poker;

b. allowing the player to obtain a card representation in addition to the two card representations, wherein the added card representation may be used during the game of poker.

29. A gaming method comprising the steps of:

a. requiring a player to place a blackjack bet;

b. requiring a player to place an ante if the player wants to play poker;

c. providing at least two card representations to a player, each card representation comprising a game symbol, the game symbol having a corresponding predetermined value;

d. providing at least two card representations to a dealer, each card representation comprising a game symbol, the game symbol having a corresponding predetermined value;

e. allowing the player to decide whether to continue playing poker;

f. requiring the player to place a poker bet if the player wants to continue playing poker;

g. playing a blackjack game, the blackjack game comprising:

i. allowing the player to obtain at least one card representation in addition to the card representations provided in step c;

ii. allowing the player to obtain at least one card representation in addition to the card representations provided in step d;

iii. evaluating the blackjack game outcome by comparing the values of the player and the dealer's card representations, wherein the player wins the blackjack game if the sum of the predetermined numerical values of the player's card representations is higher than the dealer's;

h. after playing the blackjack game, making the player select no more than two card representations obtained from playing the blackjack game and making the dealer select no more than two card representations obtained from playing the blackjack game;

h. playing a poker game, the poker game comprising:

i. using the two selected player's card representations for the game of poker, the player's card representations for the game of poker being independent from the dealer's;

ii. using the two selected dealer's card representations for the game of poker;

iii. defining a winning poker outcome; and iv. evaluating the poker outcome.

30. The gaming method of claim 29, wherein the winning poker outcome definition comprises having a card representation with the highest value.

31. The gaming method of claim 29, wherein the winning poker outcome definition comprises the player and the dealer having a highest card representation with the same value, and the player having a second highest card representation that has a higher value than the dealer's second highest card representation.

32. The gaming method of claim 29, wherein the winning poker outcome definition comprises having a pair, the pair comprising two card representations with the same value.

33. The gaming method of claim 31, wherein the winning poker outcome definition comprises having a pair that has the highest value.

34. The gaming method of claim 29, wherein the game symbol is a number and the predetermined value is based on the number.

35. The gaming method of claim 29, wherein the game symbol is a king, jack, queen, or ace and the predetermined value is based on the ranks of the king, jack, queen, or ace.

36. The gaming method of claim 29, wherein at least one of the dealer's card provided in step d is shown to the player.

37. The gaming method of claim 29, further comprising defining a dealer qualifying card and allowing the dealer to play poker against the player if the dealer possesses a card that meets the definition of the dealer qualifying card.

* * * * *